United States Patent [19]

Ford et al.

[11] 4,283,814

[45] Aug. 18, 1981

[54] METHOD AND APPARATUS FOR COILER HEAD CLEANING

[75] Inventors: David M. Ford; Gary Setzer, both of Charlotte, N.C.

[73] Assignee: Pneumafil Corporation, Charlotte, N.C.

[21] Appl. No.: 3,304

[22] Filed: Jan. 15, 1979

[51] Int. Cl.[3] ..... B65H 54/80

[52] U.S. Cl. ..... 19/159 R; 15/312 R

[58] Field of Search ..... 19/159 R, 159 A, 160, 19/263, 303, 106 R, 107, 150; 15/300 R, 306 A, 301, 312 R; 66/9 B; 57/304, 305

[56] References Cited

U.S. PATENT DOCUMENTS

| | | | |
|---|---|---|---|
| 3,287,768 | 11/1966 | Rakhorst | 19/263.1 |
| 3,377,665 | 4/1968 | Kincaid | 19/159 R |
| 3,391,528 | 7/1968 | Shackelford | 57/304 X |
| 3,407,446 | 10/1968 | Whitehurst | 19/159 R |
| 3,412,545 | 11/1968 | Lippuner | 57/304 |
| 4,208,762 | 6/1980 | Starling | 19/159 R |

*Primary Examiner*—Louis Rimrodt

*Attorney, Agent, or Firm*—Robert W. Fiddler

[57] ABSTRACT

Method and apparatus are disclosed for eliminating or minimizing air borne dust, fly, lint and the like particulate matter, and static accumulations thereof generated by the movement of sliver into the coiler trumpet of a sliver coiler. Coiler head cleaning is accomplished by confining an air flow path over the head of the coiler and establishing an air flow stream along said path to entrain dust, fly, lint and the like particulate matter released by the sliver moving into the coiler trumpet. Apparatus is provided comprising an enclosure confining a volume of air over the coiler head, with an opening leading into the enclosure through which air flowing across the trumpet is admitted. A suction connection is formed in the enclosure remote from the air inlet with air flow established in a path through the enclosure between the air inlet and the suction connection.

17 Claims, 5 Drawing Figures

FIG. 1.
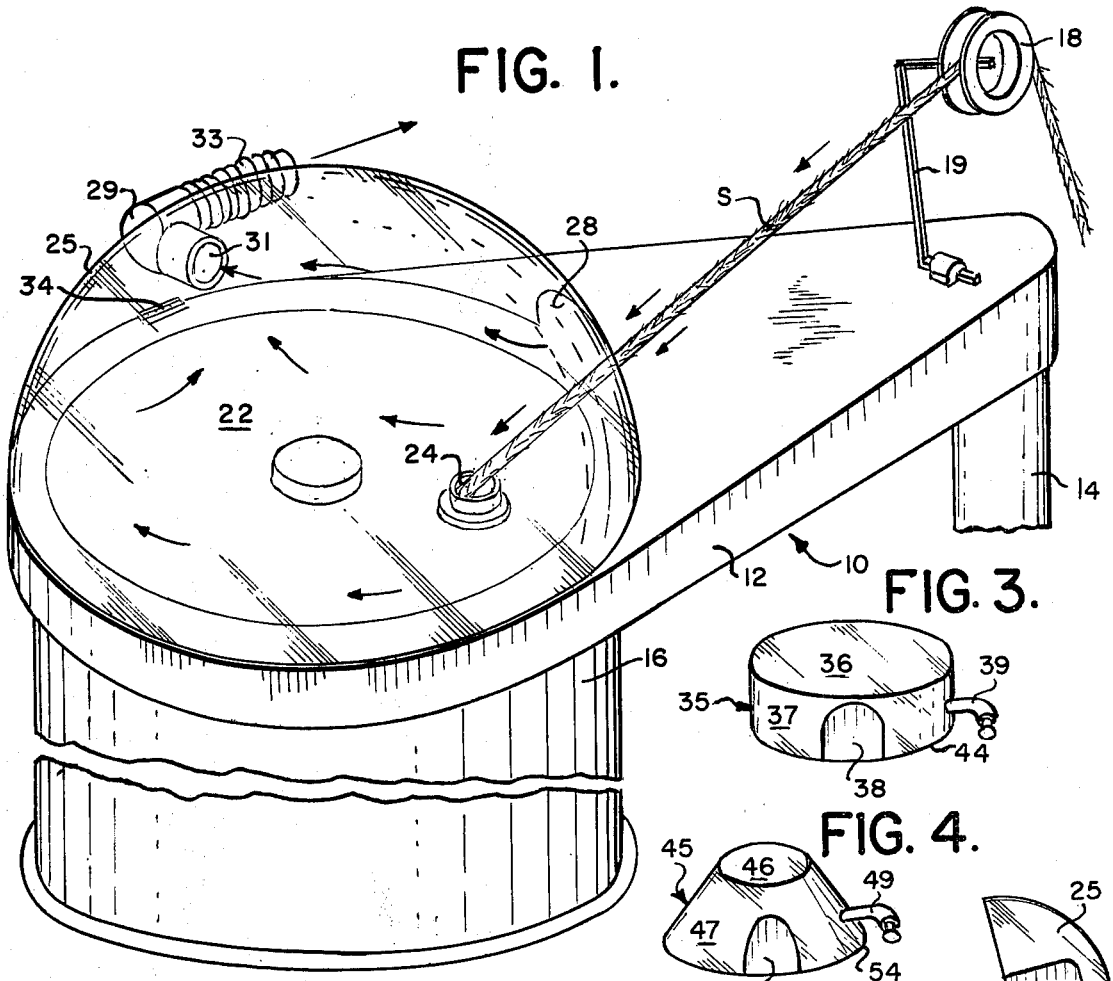
FIG. 3.
FIG. 4.
FIG. 2.
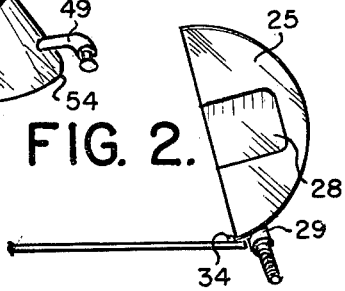
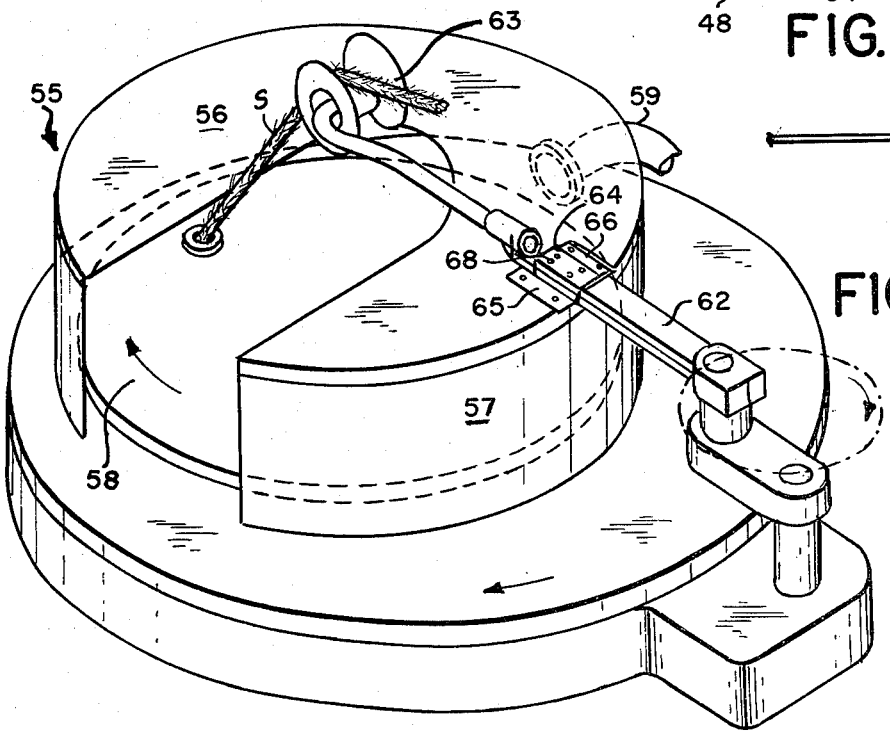
FIG. 5.

METHOD AND APPARATUS FOR COILER HEAD CLEANING

BACKGROUND OF THE INVENTION

This invention relates to the art of coiler head cleaners, and more particularly to an improved method and apparatus facilitating the elimination of accumulations of lint, fly and the like particulate matter from the head of a sliver coiler, and further serving to eliminate the entrainment of lint, fly and the like particulate matter in the ambient atmosphere in a textile mill.

Sliver coilers have long been employed to coil the sliver produced by a cotton card into a sliver can to facilitate storage and transport of the formed sliver for subsequent processing. These coilers generally comprise a support for a cylindrical storage can, with a coiler head arranged above the top of the open can. These coiler heads are of a variety of types generally employing a trumpet through which the sliver from the card is fed. Relative rotation is produced between the trumpet and the can so as to effect coiling of the sliver passing through the trumpet into the can. In passing through the trumpet, the sliver as a result of physical contact with the trumpet surfaces, and as a result of the change of direction of the sliver flow path releases varying quantities of lint, fly and the like particulate matter. Some of this particulate matter accumulates on the coiler head requiring periodic cleaning, while a part of the released particulate matter is entrained in the ambient mill atmosphere. Aside from increased production costs resulting from fiber loss and cleaning costs, the contamination of the mill atmosphere results in worker inefficiencies, and may often produce conditions violative of present working atmosphere standards as promulgated by OSHA.

BRIEF SUMMARY OF THE INVENTION

It is with the above considerations in mind, that the present improved coiler head cleaning method and apparatus has been evolved serving to minimize accumulations of lint, fly and the like particulate matter on the coiler head, and additionally, serving to collect this particulate matter before it can be entrained in the ambient atmosphere.

It is accordingly among the primary objects of this invention to provide means including both method and apparatus for collecting lint, fly and the like particulate matter released in the passage of sliver into the coiler cans.

A further object of the invention is to provide means minimizing the cleaning requirement of the heads of sliver coilers.

Another object of the invention is to provide means minimizing the entrainment of particulate matter in the ambient atmosphere about sliver coilers.

A further object of the invention is to minimize fiber loss during coiling of sliver.

These and other objects of the invention which will become hereafter apparent are achieved by confining an air flow path over the head of the coiler and establishing an air flow stream along said path to entrain any dust, fly and the like particulate matter released by the sliver moving into the coiler trumpet. Apparatus is provided comprising an enclosure arranged over the coiler head to confine a volume of air, with an opening leading into the enclosure through which air flowing across the trumpet is admitted, and a suction connection is formed in the enclosure remote from the air inlet with air flow established in a path through the enclosure.

A feature of the invention resides in the mounting of the enclosure with respect to the coiler head in a way such as not to interfere with any necessary piecing up of the sliver, or feeding of the sliver into the trumpet head.

Another feature of the invention resides in the formation of the enclosure of a transparent material such that sliver movement, and coiler operation may be visually observed by any maintenance personnel.

BRIEF DESCRIPTION OF THE DRAWINGS

The particular details of the best mode contemplated by the inventor for carrying out the invention and the manner and process of making and using same so as to enable any persons skilled in the art to make and use same will be described in full, clear, concise and exact terms, in conjunction with the accompanying drawings, wherein:

FIG. 1 is a perspective elevational view of a coiler head shown on a coiler can with the head cleaning enclosure of the invention applied thereto;

FIG. 2 is a perspective detail view showing the enclosure elevated with respect to the coiler head for maintenance purposes;

FIG. 3 is a second embodiment of the enclosure showing a right circular cylindrical configuration for the head cleaning enclosure;

FIG. 4 is another embodiment showing a frusto-conical configuration for the head cleaning enclosure; and FIG. 5 shows another embodiment of the head cleaning enclosure shown mounted on the sliver guide roll support arm.

DESCRIPTION OF PREFERRED EMBODIMENTS

Referring now more particularly to the drawings, where like numerals in the various FIGS. will be employed to designate like parts, as best seen in FIG. 1, a sliver coiler 10 is shown having a head 12 supported on a post 14, maintaining the head in position over a cylindrical sliver can 16 in which the sliver S is coiled. In conventional fashion, the sliver S is trained over a guide roller 18 mounted on a support bracket 19 affixed to the head 12. A rotating coiler disc 22 is arranged for rotation in head 12 and is formed with trumpet 24 eccentric with respect to the axis of rotation of the disc 22, so that as the disc rotates, the sliver S passing through trumpet 24 will be coiled in can 16 in conventional fashion.

In accordance with the invention, enclosure 25 shown in the embodiments of FIGS. 1 and 2, is formed of an arcuately domed configuration preferably hemispherical and of a transparent plastic material such as acrylonitrile, methylmethacrylate, or the like. In the embodiment illustrated in FIG. 1, the diameter of the enclosure 25 is such as to fit over the outer bounds of the circular portion of head 12 fully enclosing coiler disc 22. Enclosure 25 is formed with an inlet opening 28 dimensioned of a width so as to permit the sliver S to enter the enclosure 25 without contacting the sidewalls of the inlet opening 28. This is best accomplished by insuring the fact that opening 28 is at least equal in width to the throw of the sliver produced by the rotation of trumpet 24 on disc 22. A suction hose connector 29 is coupled between enclosure outlet opening 31 and flexible suction hose 33 connected to an appropriate source of suction (not shown) such as a fan, compressor or turbine intake. In the embodiment illustrated in FIG. 1, the axis of outlet opening 31 is perpendicular to the axis of inlet opening 28. Hinge 34 is provided between the base of enclosure 25, and the head 12, so as to permit movement of the enclosure to the FIG. 2 position.

In the embodiment of the invention illustratively shown in FIG. 3, the enclosure 35 is formed of a right circular cylindrical configuration of a transparent plastic material like that of enclosure 25 and is provided with a circular top wall 36 and cylindrical sidewall 37. An enclosure inlet opening 38 is provided dimensioned like inlet opening 28 in FIG. 1 to permit the sliver S to enter the enclosure without contacting the opening sidewall, and a suction connector 39 is extended from an outlet in the enclosure sidewall 37. Hinge 44 hingedly secures enclosure 35 to the head of the coiler in connection with which used.

In the FIG. 4 embodiment of the invention, enclosure 45 is illustratively shown as of a frusto-conical configuration with a circular top 46, downwardly and outwardly flared sidewalls 47, and inlet opening 48. Suction hose connector 49 is extended from the conical sidewalls 47, and hinge 54 is provided to hingedly secure the enclosure 45 to the coiler head.

In the embodiment illustrated in FIG. 5, the enclosure 55 is shown as of a right circular cylindrical configuration with a circular top wall 56 preferably formed of a clear plastic material such as acrylic or the like joined to the downwardly extending sidewall 57 which, in the illustrated embodiment, is formed preferably of a flexible material. In this embodiment, the enclosure inlet opening 58 extends from the sidewalls into the top wall 56 contoured as shown with suction hose connector 59 extending from the cylinder sidewall. The cylindrical enclosure 55 is secured to the support arm 62 for the sliver guide roll 63 by means of channel shaped mounting bracket 64 having lateral flanges 65 and 66 secured by screws or the like to the top wall 56 of the enclosure. Leveling and adjusting screws 68 are threadedly extended through tapped openings in the top of the channel for engagement with the support arm 62.

OPERATION

In using the invention, one of the above described enclosures, in one of the forms shown in the embodiments FIGS. 1, 3, 4 or 5, is mounted on the head of the coiler to be cleaned.

These enclosures are preferably formed by utilizing conventional plastic forming techniques, where the enclosures are formed of plastics. Thus, by way of example, the FIGS. 1, 3 and 4 embodiments are formed preferably by molding, whereas the FIG. 5 embodiment may be formed of sheet plastic and assembled utilizing conventional sheet plastic assembly techniques.

The enclosure is secured with respect to the head in the FIGS. 1, 3 and 4 embodiments by fastening the hinge between a lower rim of the enclosure and the fixed portion of the coiler head surrounding the coiler disc. As shown in the drawing, in the FIGS. 1, 3 and 4 embodiments of the invention, the air flow axes of the inlets to suction connectors 29 and 39 and 49 are arranged on axes perpendicular to the axes of the enclosure inlet opening 28, 38, and 48 respectively. In the embodiment of the invention illustrated in FIG. 5, however, it will be observed that the axis of the inlet opening is aligned with the axis of the discharge opening. Further, in the FIG. 5 embodiment, in lieu of utilizing the hinges 34, 44 and 54 to mount the enclosure with respect to the head, the enclosure is shown as supported on support arm 62 for the sliver guide roll 63.

In use, the enclosures, whether in the form shown in FIGS. 1, 3, 4 or 5, are mounted to enclose the rotating coiler head and the sliver feeding into the trumpet thereof. A suction hose (such as 33 in FIG. 1) is coupled between suction connectors 39, 49 or 59, and an appropriate suction source (not shown), and when the coiler is in operation, the suction source is actuated so as to establish air flow over the coiler head.

As the coiler head disc rotates, with the sliver passing into the trumpet, any lint, fly and the like particulate material produced as a result of the movement of the sliver into the trumpet, and its change of direction, is entrained into the air stream established between the inlet opening and the outlet opening in the enclosure. Accumulations of this particulate matter in the ambient atmosphere are minimized, and accumulations on the coiler head are likewise minimized, thus reducing cleaning requirements, and additionally improving the quality of the ambient air.

The above disclosure has been given by way of illustration and elucidation, and not by way of limitation, and it is desired to protect all embodiments of the invention within the scope of the appended claims.

What is claimed is:

1. A coiler head cleaner for capturing lint, dust, fly and the like particulate matter released by the passage of sliver into the trumpet of a sliver coiler having a head and trumpet through which sliver is fed to a storage can positioned beneath the trumpet, so that relative rotation is produced between the axis of the trumpet and the axis of the can to produce desired coiling of the sliver in the can, said cleaner comprising: an enclosure overlying and enclosing the head and the trumpet, said enclosure having a single air inlet opening admitting air to the enclosure and through which the sliver to be coiled is fed to the trumpet, said opening dimensioned to permit free passage of the sliver therethrough without contacting the edges of the inlet opening; said enclosure having an air outlet at a point spaced from the air inlet and the trumpet; and a suction hose connected to said enclosure through which air and any particulate matter entrained therein is withdrawn from said enclosure.

2. A coiler head cleaner as in claim 1, in which said enclosure is hingedly secured to the coiler head.

3. A coiler head as in claim 1, in which said enclosure is arcuately dome shaped.

4. A coiler head cleaner as in claim 1, in which said enclosure is of a frusto-conical shape.

5. A coiler head cleaner as in claim 1, in which said enclosure is of a cylindrical shape.

6. A coiler head cleaner as in claim 5, in which said enclosure has an air inlet formed by cutting away a part of the side and top of the cylinder forming said enclosure, with the inlet dimensioned to permit free passage of the sliver therethrough.

7. A coiler head cleaner as in claim 6, in which the sidewalls of said cylindrically shaped cleaner are flexible.

8. A coiler head cleaner as in claim 6, for cleaning a sliver coiler having a support arm for a sliver guide roll over which the sliver to be coiled is fed into the trumpet, said cleaner having said enclosure supported on the guide roll support arm.

9. A coiler head cleaner as in claim 8, in which said enclosure is secured to the guide roll support arm by a bracket having flanges secured to the enclosure, and adjusting screws threaded through said bracket into engagement with the guide roll bracket.

10. A coiler head cleaner as in claim 1, in which a hose connector is secured to said enclosure at the suction outlet.

11. A coiler head cleaner as in claim 1, in which the axis of flow through the suction outlet is at right angles to the flow axis into said enclosure air inlet opening.

12. A coiler head cleaner as in claim 1, in which the axis of flow through the suction outlet is aligned with said enclosure air inlet opening.

13. A coiler head cleaner as in claim 1, in which a suction hose connector is coupled between said suction hose and the outlet in said enclosure; and a hinge is arranged between said enclosure and the coiler head beneath said hose connector.

14. A coiler head cleaner as in claim 1, in which said enclosure is formed of a transparent material.

15. A method of capturing lint, dust, fly and the like particulate matter released by the passage of sliver into the trumpet of the silver coiler having a head and trumpet through which sliver is fed to a storage can positioned beneath the trumpet so that relative rotation is produced between the axis of the trumpet and the axis of the can to produce desired coiling of the sliver in the can, said method comprising the steps of: enclosing the head and trumpet in a confined volume; establishing an air flow path over the coiler head through the enclosed volume, along the path of movement of the sliver; establishing an air flow stream along said path; and entraining the particulate matter released over the head in the air flow stream.

16. A method as in claim 15, in which the air flow path is directed parallel to the direction of movement of the sliver.

17. A method as in claim 15, in which the air flow path is directed perpendicular to the path of travel of the sliver.

* * * * *